US007540092B2

(12) United States Patent
Polei

(10) Patent No.: US 7,540,092 B2
(45) Date of Patent: Jun. 2, 2009

(54) UTILITY KNIFE

(75) Inventor: Gudula Polei, Solingen (DE)

(73) Assignee: Martor KG, Solingen (DE)

( * ) Notice: Subject to any disclaimer, the term of this patent is extended or adjusted under 35 U.S.C. 154(b) by 231 days.

(21) Appl. No.: 11/582,854

(22) Filed: Oct. 18, 2006

(65) Prior Publication Data

US 2007/0107233 A1 May 17, 2007

(30) Foreign Application Priority Data

Oct. 24, 2005 (DE) ..... 10 2005 051 108

(51) Int. Cl.
*B26B 1/08* (2006.01)

(52) U.S. Cl. ..... 30/162

(58) Field of Classification Search ..... 30/162, 30/329, 340, 342
See application file for complete search history.

(56) References Cited

U.S. PATENT DOCUMENTS

| | | | | |
|---|---|---|---|---|
| 1,507,043 | A * | 9/1924 | Blow | 30/138 |
| 4,835,865 | A * | 6/1989 | Knoop | 30/162 |
| 4,862,590 | A * | 9/1989 | Winyard et al. | 30/161 |
| 5,337,481 | A | 8/1994 | Mears | 30/162 |
| 6,263,577 | B1 * | 7/2001 | Wonderley | 30/152 |
| 6,415,514 | B1 * | 7/2002 | Chun | 30/162 |
| 7,131,204 | B2 | 11/2006 | Brown | 30/162 |
| D557,079 | S * | 12/2007 | Schmidt | D7/649 |
| 2005/0193567 | A1 | 9/2005 | Ho | 30/162 |
| 2005/0241111 | A1 * | 11/2005 | Prokop | 16/430 |
| 2008/0083119 | A1 * | 4/2008 | Schmidt | 30/162 |

* cited by examiner

*Primary Examiner*—Jason Daniel Prone
*Assistant Examiner*—Jennifer Swinney
(74) *Attorney, Agent, or Firm*—Andrew Wilford

(57) ABSTRACT

A utility knife has an elongated housing having a pair of opposite side faces and a rear edge and formed with a longitudinal guide passage open at an end of the housing, respective side cutouts on the side faces, and a back cutout on the rear edge. A blade holder longitudinally shiftable in the housing carries a blade having a cutting edge directed forward away from the rear edge. The holder is longitudinally shiftable between a use position with the blade projecting from the housing front end and a retracted position with the blade inside the housing. Respective side and rear actuating formations are coupled to the blade holder and exposed at the side and rear cutouts so that the blade can be actuated by a user's fingers via any of the actuating formations. A spring in the housing urges the holder and blade into the retracted position.

12 Claims, 1 Drawing Sheet

UTILITY KNIFE

The invention relates to a utility knife having a housing in accordance with the introductory clause of claim 1.

Such a knife is known from DE 36 22 343 C2 (Translator's note: See U.S. Pat. No. 4,835,865). A blade holder for the knife blade is movable in a guide passage of the knife housing. The blade holder has a control member on each of its sides, each received in a respective cutout of the housing. Using the control member, the blade can be moved against the restoring force of a spring out of a retracted position in the housing into a cutting position in which the tip of the blade projects forward out of a housing opening for cutting.

This knife has the advantage that, because of the control member on both sides, it is possible both for both left- and right-handed persons to operate the knife. However, the knife is difficult to handle during a horizontal cutting motion in which pressure on the back of the knife is necessary.

A knife that is known from prior public use also has a blade holder guided in a straight-line manner in a guide passage of the knife housing. The back of the housing has a cutout through which extends a control member that is connected to the blade holder. The control member fits over the knife housing like a saddle. The knife is therefore suitable both for persons who are right-handed and for persons who are left-handed and moreover permits horizontal cuts in which thumb pressure must be exerted on the back of the knife.

However, in this knife it is disadvantageous that the knife is difficult to handle. When the control member is moved, for instance, with the thumb, the control member bumps at other locations into the hand gripping the housing Proceeding from the above-described prior art, it is therefore the object of the invention to create a knife that has improved handling.

The object is attained with the features of claim 1, in particular with the features of the characterizing clause.

The essential principle of the invention is comprised in that the knife housing now has three cutout slots, an actuating formation for the blade holder being received in each. The exterior surfaces of the knife housing that surround the cutouts form support and positioning surfaces for the fingers of the user. With regard to the surrounding exterior housing surface, the exterior surface of the actuating formation can be recessed or flush therewith. Portions of the exterior surfaces of the actuating formation can also project past the surrounding exterior housing surface.

The advantage of the invention is that the knife can be used in two different cutting positions, both by persons who are right-handed and by persons who are left-handed. In a first cutting position, the cutting pressure is applied to the back of the knife by the ball of the thumb, while in a second cutting position the thumb is positioned against the back of the knife and exerts the cutting pressure.

In accordance with a first embodiment, the surrounding exterior housing surface areas project with regard to the actuating formation, while the actuating formation is arranged at least partially recessed with respect to the exterior housing surface areas. Because the surrounding exterior surfaces that form support surfaces for the user's hand are out from the actuating formations the user's hand spans the cutout in a bridge-like manner and therefore does not come into contact in an undesired manner with the other actuating formations when one of the actuating formations is being operated.

In accordance with another embodiment, at least one actuating formation has a ridge that projects with respect to a control face of the actuating formation. The ridge forms an abutment for the control finger, preventing the finger from slipping and making it easier to move the control member. The ridge projects past the control face. It can project beyond the surrounding exterior surfaces of the knife housing, but does not have to. However, it is also possible for it to project with respect to the control face but be countersunk with respect to the surrounding exterior surface.

In accordance with another embodiment, all the actuating formations are provided on a single actuating element. The actuating formations can for instance be glued or otherwise attached to the actuating element, e.g. by clipping. The actuating element can for instance be securely attached to the blade holder or can cooperate with the blade holder in another manner, for instance by means of a coupling.

In accordance with another embodiment, the actuating formations and the actuating element are integrally joined to one another. The one-piece actuating element can be produced for instance by plastic injection molding.

In accordance with another embodiment of the invention, at least the housing area in which the cutouts are provided has a generally rectangular cross-section.

In accordance with an ergonomically advantageous embodiment, the corner areas of the largely rectangular cross-section are rounded.

In accordance with another embodiment of the invention, at least the housing area in which the cutouts are provided has a generally oval cross-section.

Additional advantages of the invention result from the dependent claims, not cited, and using the specification of an illustrated embodiment depicted in the figures.

A utility knife indicated generally at 10 is shown in the drawings. The same references in different figures apply to the same parts.

Figure 1:
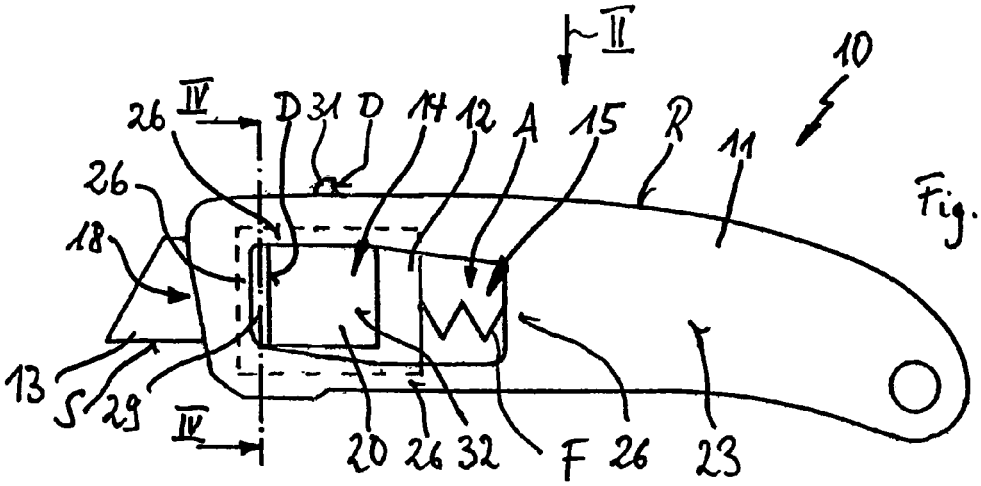
FIG. 1 is a schematic side elevation of the inventive knife.
Figure 2:
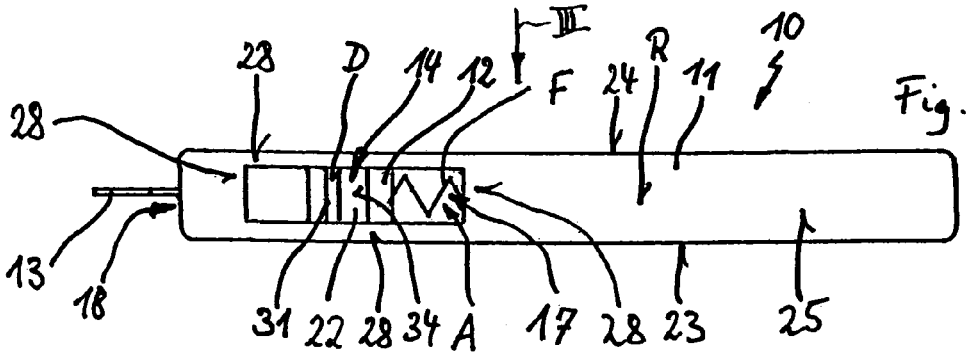
FIG. 2 is a view in accordance with arrow II of FIG. 1.
Figure 3:
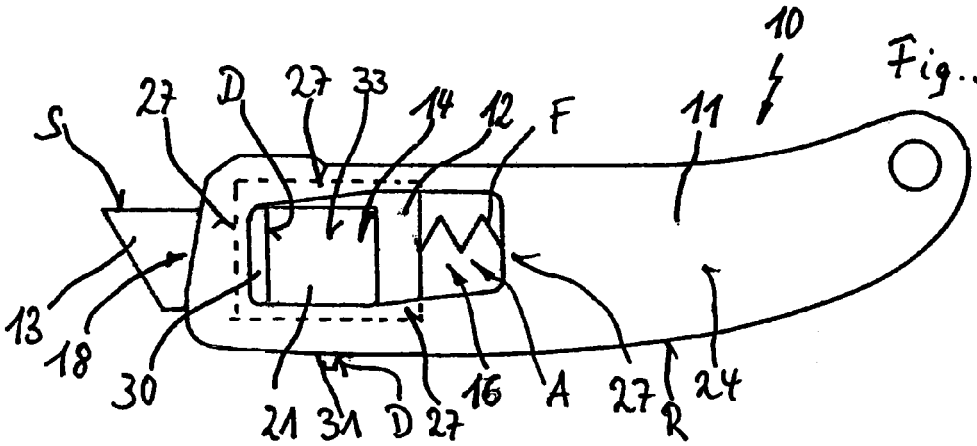
FIG. 3 is a view in accordance with arrow III in FIG. 2.
Figure 4:
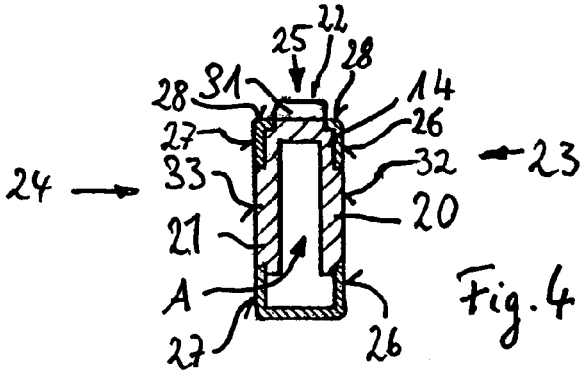
FIG. 4 is a section taken along line IV-IV of FIG. 1.

In accordance with FIG. 1, such a knife 10 essentially has a housing 11, a blade holder 12 with a blade 13, and an actuating element 14. The housing 11 is provided with somewhat slot-like cutouts 15, 16, and 17. The housing 11 furthermore has a guide passage A.

The blade holder 12 is longitudinally displaceable in a known manner in the guide passage A of the housing 11. The blade holder 12 can therefore be moved between a cutting position in accordance with FIGS. 1 through 4, in which the blade 13 projects somewhat out of an opening 18 of the housing 11, and a non-use position, not shown, in which the blade 13 is retracted into the guide passage A, so that a cutting edge S of the blade 13 does not pose any risk. The blade 13 is fitted to the blade holder 12 in a known manner. The blade holder 12 is urged rearward by a helical spring F into the non-use position.

An actuating element 14 is associated with the blade holder 12 and has integral molded actuating formations 20, 21, and 22 with control faces 32, 33, and 34. The control members 20, 21, and 22 are provided with ridges 29, 30, and 31 that each form a stop surface D for a user's control finger. The actuating element 14 can be fixed on blade holder or for instance can be joined to the blade holder via a coupling.

The actuating formation 20 is accessible via the cutout 15, the actuating formation 21 via the cutout 16, and the actuating formation 22 via the cutout 17. The knife 10 therefore makes it possible to actuate the blade holder 12 in two different holding positions of the knife 10. In one cutting position, the cutting pressure is applied to the back of the knife R with the ball of the thumb. Depending on whether the knife 10 is being used by a person who is right-handed or a person who is left-handed, the blade holder 12 can then be controlled by means of the actuating formations 20 or 21. In another cutting position, the cutting pressure is applied to the back of the knife R with the thumb. Persons who are right-handed and persons who are left-handed can then control the blade holder by means of the actuating formation 22. Thus, by means of the inventive knife it is possible to move the blade holder 12 from the non-use position to the cutting position from three housing sides 23, 24, and 25.

The cutout 15 is surrounded by an exterior surface region 26, the cutout 16 by an exterior surface region 27, and the cutout 17 by an exterior surface region 28 of the housing 11. As can be seen from FIGS. 1 through 4, the actuating formations 20 and 21 and the molded ridges 29 and 30 recessed below or inward of the exterior housing surfaces 26 and 27 surrounding them. The actuating formation 22 is also recessed with respect to the exterior housing surface 25, but the molded ridge 31 projects slightly outward past the exterior housing surface 28.

It should be stressed that when operating for instance the actuating formation 22 with the thumb of the right hand, the other fingers gripping the housing 11 do not come into contact with the other control members 20 and 21, since the surrounding exterior housing surfaces 26 and 27 form finger and hand grip surfaces. Due to the exterior housing surfaces 26 and 27, which form positioning surfaces, the hand spans the cutouts 26 and 27 in a bridge-like manner and does not contact the actuating formations 20 and 21. This advantageous effect also occurs when the actuating formations 20 and 21 are actuated.

In contrast to the representation in FIGS. 1 through 4, the ridge can also be countersunk with respect to the exterior housing surfaces 28.

The invention claimed is:

1. A utility knife comprising:

an elongated housing having a pair of opposite side faces and a rear edge forming support and position surfaces for the fingers of a user of the knife, the housing further being formed with a longitudinal guide passage open at a longitudinal end of the housing, respective transversely oppositely open side cutouts on the side faces, and a transversely open back cutout on the rear edge;

a blade holder longitudinally shiftable in the housing;

a blade fitted to the holder and having a cutting edge directed forward away from the rear edge, the holder being longitudinally shiftable between a use position with the blade projecting from the housing front end and a retracted position with the blade inside the housing;

two transversely oppositely projecting side actuating formation and one rear actuating formation coupled to the blade holder and exposed at the side and rear cutouts such that the blade can be actuated by a user's fingers via any of the actuating formations; and a spring in the housing urging the holder and blade into the retracted position.

2. The utility knife defined in claim 1 wherein the cutouts are elongated longitudinally of the housing.

3. The utility knife defined in claim 1 wherein the actuating formations have outer faces that are generally flush with respective outer surface regions of the housing surrounding the respective cutouts.

4. The utility knife defined in claim 1 wherein the actuating formations have outer faces that are at least partially recessed relative to outer surface regions of the housing surrounding the respective cutouts.

5. The utility knife defined in claim 1 wherein at least one of the actuating formations has a ridge projecting outward past an outer surface region of the housing surrounding the respective cutout.

6. The utility knife defined in claim 5 wherein the ridge extends transversely.

7. The utility knife defined in claim 6 wherein the rear actuating formation is formed with the ridge.

8. The utility knife defined in claim 6 wherein each of the actuating formations is formed with a respective such ridge.

9. The utility knife defined in claim 1 wherein all the actuating formations are formed on an actuating member.

10. The utility knife defined in claim 1 wherein the formations, actuating member, and holder are all unitary.

11. The utility knife defined in claim 1 wherein the housing is of generally rectangular section at the cutouts.

12. The utility knife defined in claim 1 wherein the housing is of generally oval section at the cutouts.

* * * * *